United States Patent [19]

Ginzburg

[11] 4,384,468

[45] May 24, 1983

[54] METHOD AND APPARATUS FOR COILING STRIP ON A HOT MILL

[75] Inventor: Vladimir B. Ginzburg, Pittsburgh, Pa.

[73] Assignee: Tippins Machinery Company, Inc., Pittsburgh, Pa.

[21] Appl. No.: 306,893

[22] Filed: Sep. 29, 1981

[51] Int. Cl.[3] ..... B21B 1/26; B21B 9/00; B21B 41/00; B21B 41/08

[52] U.S. Cl. ..... 72/202; 72/227; 72/231; 72/234

[58] Field of Search ..... 72/200, 202, 226, 227, 72/228, 231, 234, 146, 201

[56] References Cited

U.S. PATENT DOCUMENTS

| | | | |
|---|---|---|---|
| 2,658,741 | 11/1953 | Schmidt et al. | 72/200 X |
| 3,486,359 | 12/1969 | Hein | 72/228 X |
| 3,729,972 | 5/1973 | Kocks | 72/202 X |
| 3,805,570 | 4/1974 | Smith | 72/231 X |
| 4,083,218 | 4/1978 | Berz | 72/228 X |
| 4,263,798 | 4/1981 | Wladika et al. | 72/202 |
| 4,308,739 | 1/1982 | Tippins | 72/202 |

FOREIGN PATENT DOCUMENTS

| | | | |
|---|---|---|---|
| 55-84207 | 6/1980 | Japan | 72/200 |

*Primary Examiner*—Ervin M. Combs

*Attorney, Agent, or Firm*—Webb, Burden, Robinson & Webb

[57] ABSTRACT

The hot strip mill includes a pair of coilers immediately downstream of and adjacent the finishing train. The coilers are vertically aligned and on opposite sides of the pass line. The strip coming out of the last finishing stand is immediately coiled in one of the vertical coilers, while the other vertical coiler may simultaneously be uncoiling and directing a previously rolled strip along the runout table to a coiler at the end of the runout table.

6 Claims, 3 Drawing Figures

METHOD AND APPARATUS FOR COILING STRIP ON A HOT MILL

FIELD OF THE INVENTION

My invention relates to hot strip mills and, more particularly, to the placement of coilers or coiler furnaces downstream of the finishing mill in a hot strip mill.

DESCRIPTION OF THE PRIOR ART

The general arrangement of a modern hot strip mill includes a runout table of substantial length located between the last finishing stand of the finishing train and the coilers. The runout table which often reaches lengths in excess of 400 feet is provided with water sprays above and below the table rolls for rapid cooling of the rolled strip to the desired temperature for coiling. The strip which is carried along the runout table on a driven roller conveyor is coiled in one of a plurality of coilers located at the end of the runout table.

The metallurgy of the hot rolled strip is controlled in part by the temperature of the strip leaving the finishing mill and the coiling temperature of the strip in the downcoilers. The last hot rolling operation on the last finishing stand is normally conducted above the upper critical temperature of the steel on virtually all continuous hot mill flat rolled products. Such a practice permits the rolled steel to pass through a phase transformation after all hot work is finished and produce a uniformly fine equiaxed ferritic grain throughout the strip. Standard low carbon steels generally require finishing temperatures above 1560° F. The runout table following the last finishing stand is long enough and equipped with enough quenching sprays to cool the strip on the order of 200° to 500° below the finishing temperature before the strip is finally coiled. This temperature drop is necessary because of the self-annealing effect of a large mass of steel coiled at elevated temperatures. This self-annealing effect affects carbide formation and, to a lesser extent, grain size. Coiling at slightly lower temperatures on the order of 1200° F. or less yields a finer and dispersed ferroidal carbide resulting in a somewhat harder sheet which still retains excellent ductility on drawing.

With the advent of longer slabs from slab casters and the always increasing demand for larger coils, the runout tables have been lengthened to achieve the necessary cooling and handling associated therewith. In addition, since the strip is at its thinnest gauge on the runout table and is traveling at its fastest speed (often on the order of 2,000 ft./min.) the likelihood of cobbling is the greatest in the area of the runout table. Hot mill designs which attempt to achieve greater speeds require even larger runout tables in order to achieve the proper cooling.

SUMMARY OF THE INVENTION

My invention greatly shortens the length of the runout table without sacrificing any of the properties or product capabilities of the standard table lengths. In addition, my invention greatly reduces the likelihood for cobbles by substantially reducing the speed in which the strip passes along the runout table. The coiling of the strip on the downcoilers at the end of the runout table is conducted independently of the cycle time through the finishing train.

My invention is the placement of vertical coilers immediately adjacent to and downstream of the last finishing stand in the finishing train. The coilers which are vertically aligned are on opposite sides of the pass line. Strip coming out of the last finishing stand is immediately coiled in one of the vertical coilers. Thereafter, the other vertical coiler is utilized in conjunction with the finishing train while the first coiler simultaneously uncoils and directs the strip down the runout table to the downcoilers.

DESCRIPTION OF THE PREFERRED EMBODIMENTS

Figure 1:
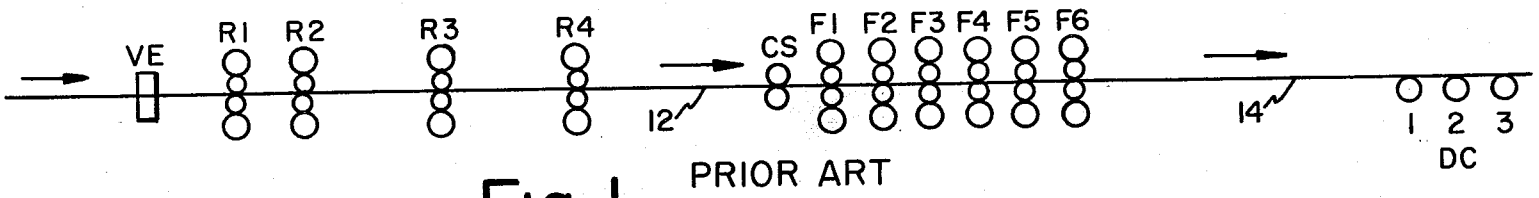
PRIOR ART Fig. 1
FIG. 1 is a schematic of the general arrangement of a standard continuous hot strip mill.

The general arrangement of a modern continuous hot strip mill is illustrated in FIG. 1. Slabs enter the hot strip mill pass line from a plurality of slab reheat furnaces (not shown). The first section of the hot strip mill is the roughing train and includes a plurality of two or four high mills which reduce the slab in thickness to an intermediate transfer bar. Four such roughing stands R1 through R4 are illustrated although a number of different arrangements including roughing reversing mills and in-tandem continuous roughers have been employed. In addition, various types of scale breakers and vertical edgers are employed with certain or all of the roughing stands and one such vertical edger VE is illustrated upstream of R1. Separating the roughing train from the finishing train is a holding table 12 on which the transfer bar is held prior to introduction into the first stand of the continuous finishing train. A crop shear CS usually precedes the first stand of the finishing train to square up the transfer bar and remove any end defects.

The finishing train includes a plurality of four high continuous finishing stands F1 through F6, FIG. 1. These stands are close coupled to one another and operated in tandem and synchronization within the speed cone of the finishing train. Exiting the last finishing stand F6 the strip which has now been reduced to its final thickness enters the long runout table 14 where it is appropriately cooled by water sprays prior to being coiled on downcoilers 1–3. Driven rollers are used to convey the slab and transfer bar and strip along the pass line when the workpiece is not being driven by the reducing rolls themselves.

The strip normally leaves the finishing mill at speeds on the order of 2000 ft./min. Since the strip is fed into the downcoilers at the same speed, the cycle time for the downcoilers is equal to the cycle time for the finishing mill. Since the strip is at its thinnest and since the speed is at its maximum, the area of the runout table is where the greatest number of cobbles occur.

Figure 2:
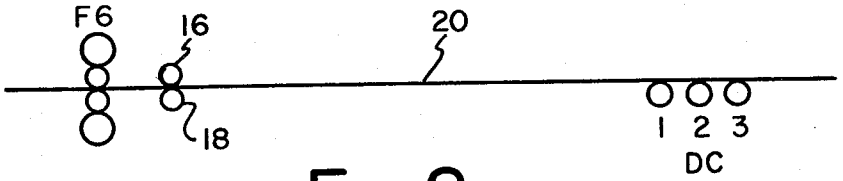
FIG. 2 is a schematic of the tail end of a hot strip mill employing my invention.
Figure 3:
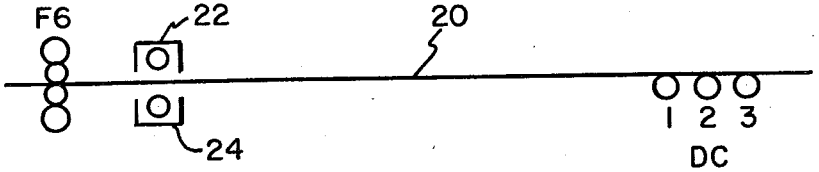
FIG. 3 is a schematic of a tail end of a hot strip mill embodying a modified form of my invention.

In order to reduce the length of the runout table and to slow down the speed of the strip to minimize cobbles, I have provided a pair of vertical coilers 16 and 18 immediately downstream of and adjacent the last finishing stand F6, FIG. 2. These coilers can be any one of a number of coilers used to coil strip and which accept a strip for coiling from one direction and uncoil in the opposite direction. The details of the coilers do not form a part of this invention. The coilers 16 and 18 are in vertical alignment on opposite sides of the pass line for reasons which will be explained hereinafter. It is often desirable to place the coilers 16 and 18 into individual furnaces such as furnaces 22 and 24, respectively, as illustrated in FIG. 3. While the furnaces are not absolutely necessary, the heat from the furnace protects the drums about which the strip is coiled so as to eliminate heat shock.

The operation of my vertical coilers downstream of the last finishing stand F6 is as follows. As the strip leaves F6 it is immediately coiled in one of the coilers 16. The coiler 16 accepts the strip at its exit speed which, as stated, is on the order of 2000 ft./min. After the strip exits F6, it is completely contained in coil form within coiler 16. The subsequent strip processed through F6 is wound on the other coiler 18. Simultaneously with coiler 18 receiving the second strip, the first strip is decoiled and directed down the runout table 20 and to one of the downcoilers 1–3.

The cycle time of the downcoilers is now totally independent of the cycle time through the finishing train and the speed of the strip from either of the vertical coilers is greatly reduced into the downcoilers as compared to the previous standard practice.

The length of the runout table is shortened in approximate proportional linear relationship to the speed. An existing mill has a runout length on the order of 300 feet and receives a strip at 2000 ft./min. Heretofore the cycle time for the downcoiler was equivalent to the cycle time of the finishing mill. Under my system the cycle time of the downcoiler can be made equal to the cycle time of the roughing train or to the cycle time of an intermediate mill, if employed. For example, if the finishing mill has a cycle time of 100 seconds, under previous practice the cycle time of the downcoiler would also be 100 seconds. If the roughing mill or intermediate mill has a cycle time of 150 seconds, this can be equated to the cycle time of the downcoiler. Therefore, operating at a cycle time of 150 seconds, a downcoiler can now receive material at (2000 ft./min.×100 secs.)/150 secs. or 1333 ft./min. The existing length of the runout table necessary to accommodate the strip is thus shortened by (300 ft.×1333 ft./min.)/2000 ft./min. or to 200 feet. At todays construction costs, it has been estimated that the total construction costs of a hot strip mill is on the order approaching $60,000.00/ft. The reduction of the runout table from 300 feet to 200 feet represents a savings on the order of $6,000,000.00 based on these estimated costs.

I claim:

1. In a hot strip mill for reducing metal slabs to coils of strip thickness along a pass line including a finishing train comprising a plurality of roll stands F1 . . . Fx, wherein Fx is a final finishing roll stand, a runout table and first coilers positioned at a downstream end of the runout table, the improvement comprising a pair of second coilers positioned upstream of said first coilers and downstream of and adjacent to said roll stand Fx, said second coilers being positioned on opposite sides of said pass line for coiling workpieces exiting said roll stand Fx in one of said second coilers while the other of said coilers directs a previously rolled workpiece to said first coilers at said down stream end of said runout table.

2. The improvement of claim 1 wherein said second coilers are in substantial vertical alignment.

3. The improvement of claims 1 and 2 wherein each of said coilers is housed in a furnace.

4. In a method of hot rolling slabs into coils of strip thickness on a hot strip mill including reducing the workpiece to a desired strip thickness at a desired finishing temperature on a finishing train comprised of a plurality of continuous mill stands F1 . . . Fx, wherein Fx is a final finishing roll stand passing the strip along a runout table while reducing the temperature of the strip and coiling the strip at a desired coiling temperature on a first coiler positioned at a down stream end of the runout table, the improvement comprising coiling the strip immediately after it exits from said roll stand Fx on one of two coilers positioned on opposite sides of said pass line and adjacent to said roll stand Fx and thereafter uncoiling and directing said coiled strip along said runout table into said first coiler while simultaneously coiling a second strip issuing from said roll stand Fx in the other of said two second coilers.

5. The improvement of claim 4 including positioning second coilers in substantial vertical alignment.

6. The method of claims 4 and 5 including supplying external heat to the environs of each of said vertically aligned second coilers.

* * * * *

UNITED STATES PATENT AND TRADEMARK OFFICE

CERTIFICATE OF CORRECTION

PATENT NO. : 4,384,468

DATED : May 24, 1983

INVENTOR(S) : Vladimir B. Ginzburg

It is certified that error appears in the above-identified patent and that said Letters Patent are hereby corrected as shown below:

Claim 1 - Column 4 Line 17 "said coilers" should read --said second coilers--.

Claim 5 - Column 4 Line 41 Before "second" insert --said--.

Signed and Sealed this

*Eighteenth* Day of *October 1983*

[SEAL]

*Attest:*

GERALD J. MOSSINGHOFF

*Attesting Officer*

*Commissioner of Patents and Trademarks*